US009653856B2

(12) United States Patent
McSweyn

(10) Patent No.: US 9,653,856 B2
(45) Date of Patent: May 16, 2017

(54) PORTABLE UNIVERSAL SERIAL BUS (USB) CABLE KEYCHAIN ASSEMBLY WITH CARABINER CLIP

(71) Applicant: Christopher McSweyn, Oxnard, CA (US)

(72) Inventor: Christopher McSweyn, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 138 days.

(21) Appl. No.: 14/301,158

(22) Filed: Jun. 10, 2014

(65) Prior Publication Data

US 2014/0295698 A1 Oct. 2, 2014

Related U.S. Application Data

(60) Division of application No. 13/110,558, filed on May 18, 2011, now Pat. No. 8,758,045, which is a (Continued)

(51) Int. Cl.
*H01R 13/72* (2006.01)
*H01R 13/60* (2006.01)
(Continued)

(52) U.S. Cl.
CPC ..... *H01R 13/72* (2013.01); *H01R 13/60* (2013.01); *H01R 31/06* (2013.01); *H01R 2107/00* (2013.01)

(58) Field of Classification Search
CPC ..... H01R 13/72; H01R 25/00; H01R 31/06; H02G 11/02; H05K 7/142
(Continued)

(56) References Cited

U.S. PATENT DOCUMENTS 3,853,285 A 12/1974 Woodring
4,653,833 A 3/1987 Czubernat et al.
(Continued)

FOREIGN PATENT DOCUMENTS

CN 2678200 Y 2/2005
WO 2009134152 A1 11/2009
WO 2012162075 A1 11/2012

OTHER PUBLICATIONS

USB Powered Mobile Phone Charger with Multiple Connectors and USB A-type LED Light Plug Indicators, dated Oct. 1, 2008, website: http://www.globalsources.com/gsol/I/USB-mobile/p/sm/1001785890.htm#1001785890.
(Continued)

*Primary Examiner* — Hae Moon Hyeon
(74) *Attorney, Agent, or Firm* — Arent Fox LLP

(57) ABSTRACT

A cable assembly for connecting a portable electronic device to a host device includes an upstream connector section comprising a upstream connector housing, an upstream connector secured to the upstream connector housing, and a downstream connector section comprising a downstream connector housing, a first downstream connector secured to the downstream connector housing, and a second downstream connector secured to the downstream connector housing. The cable assembly further includes a main body section having an attachment mechanism comprising a through hole formed in the main body, the through hole including on one side a carabiner clip comprising a spring-loaded hinged inwardly movable outer portion completing the through hole.

17 Claims, 7 Drawing Sheets

Related U.S. Application Data continuation-in-part of application No. PCT/US2011/028382, filed on Mar. 14, 2011, which is a continuation of application No. 12/723,562, filed on Mar. 12, 2010, now Pat. No. 7,942,691.

(51) Int. Cl.
*H01R 31/06* (2006.01)
*H01R 107/00* (2006.01)

(58) Field of Classification Search
USPC ..... 439/504, 4, 638, 639, 529; 361/752
See application file for complete search history.

(56) References Cited

U.S. PATENT DOCUMENTS

| | | | | |
|---|---|---|---|---|
| 5,214,368 | A | 5/1993 | Wells | |
| 6,254,025 | B1 | 7/2001 | Liao | |
| 6,416,355 | B1 | 7/2002 | Liao | |
| 6,428,348 | B1 | 8/2002 | Bean | |
| 6,433,274 | B1 | 8/2002 | Doss et al. | |
| 6,722,917 | B2 | 4/2004 | Huang | |
| 6,733,328 | B2 | 5/2004 | Lin et al. | |
| 6,848,937 | B1 | 2/2005 | Hsiao | |
| 7,057,108 | B1 | 6/2006 | Sodemann et al. | |
| 7,077,693 | B1 | 7/2006 | Symons | |
| 7,125,282 | B2 * | 10/2006 | Huang | H01R 31/06 191/12.2 R |
| 7,136,288 | B2 | 11/2006 | Hoogerdijk | |
| 7,140,910 | B1 * | 11/2006 | Liao | H01R 13/72 439/501 |
| 7,273,384 | B1 | 9/2007 | So | |
| 7,467,971 | B2 | 12/2008 | Lin et al. | |
| D624,747 | S | 10/2010 | McSweyn | |
| 7,841,903 | B2 | 11/2010 | Saito | |
| 7,911,757 | B2 | 3/2011 | Hsu | |
| 7,918,685 | B1 | 4/2011 | Kruckenberg | |
| 7,942,691 | B1 | 5/2011 | McSweyn | |
| 8,215,983 | B2 | 7/2012 | Obata et al. | |
| 8,668,160 | B2 * | 3/2014 | Cheng | B65H 75/4473 242/400.1 |
| 8,870,601 | B2 * | 10/2014 | Lee | H01R 31/06 439/131 |
| 8,936,489 | B2 * | 1/2015 | Liao | H01R 27/02 439/638 |
| 2003/0148656 | A1 | 8/2003 | Huang | |
| 2003/0207611 | A1 | 11/2003 | Lin | |
| 2005/0009404 | A1 | 1/2005 | Lee | |
| 2005/0042915 | A1 | 2/2005 | Hsiao | |
| 2006/0046561 | A1 | 3/2006 | Lam et al. | |
| 2006/0160412 | A1 | 7/2006 | Symons | |
| 2006/0172591 | A1 | 8/2006 | Huang | |
| 2007/0020993 | A1 | 1/2007 | Symons | |
| 2007/0054550 | A1 | 3/2007 | Cuthbert et al. | |
| 2008/0133806 | A1 | 6/2008 | Mori | |
| 2008/0133815 | A1 | 6/2008 | Mori | |
| 2008/0143290 | A1 | 6/2008 | Chavakula | |
| 2008/0239681 | A1 | 10/2008 | Iida | |
| 2009/0102414 | A1 | 4/2009 | Fowler | |
| 2009/0156053 | A1 | 6/2009 | Hwang et al. | |
| 2010/0052613 | A1 | 3/2010 | Leung et al. | |
| 2010/0067197 | A1 | 3/2010 | Guccione et al. | |
| 2010/0315752 | A1 | 12/2010 | Rabu | |
| 2011/0215759 | A1 | 9/2011 | Lee | |
| 2013/0140394 | A1 * | 6/2013 | Cheng | B65H 75/4473 242/400.1 |

OTHER PUBLICATIONS iPhone Retractable Travel Dual-USB Charger Kit with Folding Blade, Copyright 2009 OrionGadgets & Store. iPhoneWorld.ca., web address—http://store.iphoneworld.ca/Apple-iPhone-3GS-Retractable-Travel-Dual-USB-Charger-Kit-with-folding-blade-black-prodid.

Amazon.com: compact and retractable USB Power Port Ready charge cable designed for the Aerb Waterproof MP3 Player and uses TipExchange: MP3 Players & Accessories Jan. 1, 2009.

Micro Innov:HP Mobile USB 2.0 4-Port Hub Apr. 11, 2006.

Solio H1000 Solar Charger Review—Hacked Gadgets Gçô, Mar. 5, 2008.

Targus USB Hub, Copyright 2008 Targus Group International, Inc.

International Preliminary Report on Patentability dated Nov. 13, 2013 and Written Opinion for dated Oct. 2, 2012, regarding PCT Application No. PCT/US2012/038263.

Scosche. Scosche Keychain USB 2.0 for all BlackBerry models flipSYNK (Black). Feb. 15, 2010 (Feb. 15, 2010) [retrieved on Sep. 14, 2012]. Retrieved from the internet: <URL: http://www.amazon.com/Scosche-Keychain-BlackBerry-models-flipSYNK/dp/B003554F80> entire document.

First China Office Action dated Aug. 12, 2014 regarding China Application No. CN201180023569.4.

International Preliminary Report on Patentability dated Sep. 18, 2012 and Written Opinion dated Jun. 15, 2011 regarding PCT/US2011/028382.

International Search Report dated Jun. 15, 2011 regarding PCT/US2011/028382.

International Search Report dated Oct. 2, 2012 regarding PCT/US2012/038263.

Canadian Office Action dated Jun. 29, 2015 regarding Canadian Application No. 2,839,859.

Second China Office Action dated Jun. 10, 2015, regarding China Application No. CN201180023569.4.

Third China Office Action dated Jan. 4, 2016, regarding China Application No. CN201180023569.4.

* cited by examiner

PORTABLE UNIVERSAL SERIAL BUS (USB) CABLE KEYCHAIN ASSEMBLY WITH CARABINER CLIP

CROSS REFERENCE TO RELATED APPLICATION

This present application is a divisional application of non-provisional patent application U.S. patent application Ser. No. 13/110,558, filed on May 18, 2011, which is a continuation-in-part of PCT/US11/28382, filed Mar. 14, 2011, designating the United States, which is a continuation of non-provisional patent application U.S. patent application Ser. No. 12/723,562, filed Mar. 12, 2010, now U.S. Pat. No. 7,942,691.

BACKGROUND

Field

The present disclosure relates to a cable, and more particularly, to a compact and portable Universal Serial Bus (USB) cable that can be configured as a keychain accessory with a carabiner clip.

Description of Related Art

USB cables to connect portable electronic devices to host devices are well-known in the art. However, there is a need for a more compact portable cable assembly that can be transported easily by a user, eliminates the tangle and hassle of loose wires, and is ergonomically and aesthetically pleasing to the user.

SUMMARY

In one aspect of the disclosure, a cable assembly for connecting a portable electronic device to a host device includes a cable, an upstream connector, a downstream connector connected to the upstream connector by the cable, and a main body section having an attachment mechanism comprising a through hole formed in the main body, the through hole including on a side a carabiner clip comprising a hinged spring-loaded inwardly movable portion completing the through hole.

In yet another aspect of the disclosure, a cable assembly for connecting a portable electronic device to a host device includes an upstream connector section having an upstream connector housing and an upstream connector secured to the upstream connector housing, a downstream connector section having a downstream housing, a first downstream connector secured to the downstream housing, a second downstream connector secured to the downstream connector housing, a main body section having an attachment mechanism comprising a through hole formed in the main body, the through hole including on one side a carabiner clip comprising a spring-loaded hinged inwardly movable outer portion completing the through hole.

It is understood that other aspects of a USB cable assembly will become readily apparent to those skilled in the art from the following detailed description, wherein it is shown and described only exemplary configurations of a cable assembly. As will be realized, the disclosure includes other and different aspects of a cable assembly and the various details presented throughout this disclosure are capable of modification in various other respects, all without departing from the spirit and scope of the disclosure. Accordingly, the drawings and the detailed description are to be regarded as illustrative in nature and not as restrictive.

DETAILED DESCRIPTION

Figure 1:
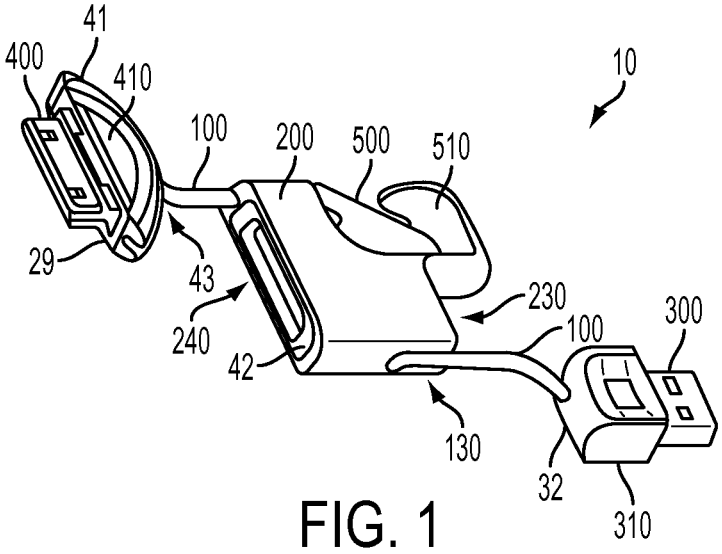
FIG. 1 is a first perspective view of a first embodiment of a cable assembly in a first configuration, in accordance with aspects of the present disclosure.

The present disclosure is described more fully hereinafter with reference to the accompanying drawings, in which various aspects of a compact and portable USB cable assembly including a carabiner clip are shown. This disclosure, however, may be embodied in many different forms and should not be construed as limited by the various aspects of the USB cable assembly presented herein. The detailed description of the USB cable assembly is provided below so that this disclosure will be thorough and complete, and will fully convey the scope of the present disclosure to those skilled in the art.

The detailed description may include specific details for illustrating various aspects of a USB cable assembly. However, it will be apparent to those skilled in the art that the disclosure may be practiced without these specific details. In some instances, well known elements may be shown in block diagram form, or omitted, to avoid obscuring the inventive concepts presented throughout this disclosure.

By way of example, various aspects of a USB cable assembly may be illustrated by describing components that are coupled, attached or connected together. However, the disclosure, while described in terms of a USB cable assembly, may be practiced with other cable and connector standards and formats. As used herein, the terms "coupled", "attached", and "connected" may be used to indicate either a direct connection between two components or, where appropriate, an indirect connection to one another through intervening or intermediate components. In contrast, when a component is referred to as being "directly coupled", "directly attached" or "directly connected" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of a USB cable assembly in addition to the orientation depicted in the drawings. By way of example, if a USB cable assembly in the drawings is turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a USB cable assembly may be illustrated with reference to one or more exemplary embodiments. As used herein, the term "exemplary" means "serving as an example, instance, or illustration," and should not necessarily be construed as preferred or advantageous over other embodiments of a USB cable assembly disclosed herein.

The USB cable assembly is compact and portable so that it can easily be stowed for transport, greatly enhancing a consumer's ability to use the USB cable assembly to recharge, power, and/or perform data transfer/synchronization for one or more portable electronic devices (PEDs) that rely on a USB port for power, recharging and/or data transfer. The USB cable assembly may be configured to provide one or more USB 5V connectors for connecting to one or more PEDs when plugged into a host device, which may be a personal computer, for example.

FIG. 1 provides a perspective view of a USB cable assembly 10 in accordance with aspects of the present disclosure. The USB cable assembly 10 is configured to connect a PED to a host device, such as a computer, for example. A USB cable 100 connects an upstream connector 300, which is preferably a male 4 pin Type A USB connector, to a downstream connector 400, which may be a 30 pin connector, for example, of the type typically used as a dock connector for an iPOD® or iPhone®, via a main body section 200. The USB cable 100 may be a shielded cable having two wires, a power and a ground wire, for delivering power at 5 volts from the host to the PED, and a braided pair of wires for carrying data between the host and the PED.

In accordance with another aspect of the present disclosure, the USB cable assembly 10 may be provided with a suitable attachment mechanism, such as carabiner clip, as shown in FIGS. 1-4, that completes a through-hole 510 formed in the main body section 200. The carabiner clip includes a hinged spring-loaded arm 500 that swings inwardly into the through-hole 510 to enable easy (e.g., one-handed) attachment, for example, to a belt loop, or a ring, such as on a backpack. In this manner, and due to its compact, lightweight and ergonomic design, the USB cable assembly 10 may be easily stored and/or transported for convenient access and efficient use.

As depicted in FIG. 1, the USB cable assembly 10 is in an operational configuration and includes the main body section 200, a detachable upstream connector body section 310 coupled to the upstream connector 300, and a detachable downstream connector body section 410 coupled to the downstream connector 400. The main body section 200 includes an upstream connector port 230 (see also FIG. 2) and a downstream connector port 240 for slidably receiving the upstream and downstream connectors, 300 and 400, respectively. In the operational configuration, the upstream and downstream connectors, 300 and 400, are disengaged from the respective upstream and downstream connector ports 230 and 240, respectively, so that the upstream connector body section 310 and the downstream connector body section 410 may be separated from the main body section 200. The upstream connector body section 310 and the downstream connector body section 410 remain connected to the main body section 200 by way of the USB cable 100. Thus, in the operational configuration, the upstream connector 300 is available for attachment to a Type A USB connector port, for example, on the host device, and the downstream connector 400 is available for attachment to the PED.

Figure 4:
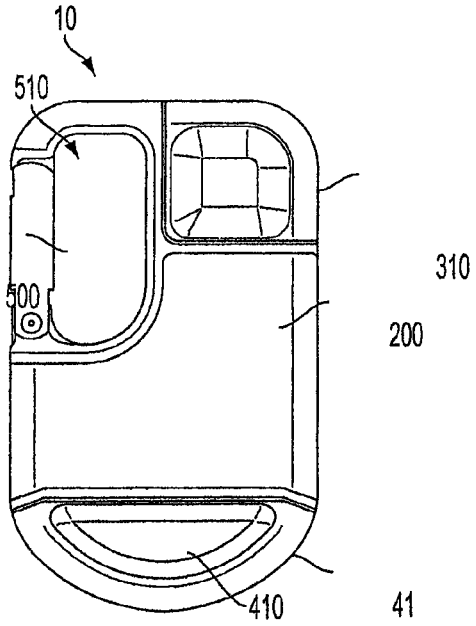
FIGS. 4-8 are various views of the cable assembly shown in FIG. 2 in a second configuration, in accordance with aspects of the present disclosure.

As shown in FIG. 4, when the USB cable assembly 10 is in a storage configuration, the upstream and downstream connectors, 300 and 400 are secured in the upstream and downstream connector ports, 230 and 240, respectively. The upstream connector body section 310 and the downstream connector body section 410 mate with the main body section 200 to form a unified body that may be generally flat, with smooth front and rear surfaces, and rounded corners and edges. The upstream connector body section 310 may be formed with rounded peripheral edges that align with the rounded peripheral edges of the main body section 200 when the upstream connector 300 is placed in a stored position, i.e., when fully inserted into the upstream connector port 230. The smooth, rounded contours of the USB cable assembly 10 allow a user to store the assembly 10 in garment pockets, for example, without snagging and tearing. Additionally, as shown in FIG. 2, the hinged spring-loaded arm 500 of the carabiner clip may be pressed inwardly toward the through-hole 510 for easy attachment to a loop on a garment, backpack, computer bag, or the like.

As shown in FIGS. 1-4, the main body section 200 may be formed with an outer casing made of nonconductive material. The outer casing may be formed from a combination of two molded shells, for example, or any other method of forming a protected enclosure for securing and protecting the upstream connector 300, the downstream connector 400, and the USB cable 100 connecting the upstream connector 300 to the downstream connector 400. The main body section 200 may be generally hollow, for example, and formed with various features for providing structural support and positional guidance, for example, of the USB cable 100.

When in the stored position, the upstream connector body section 310 mates with the main body section 200 in a position offset to one side of a longitudinal centerline (not shown) of the USB cable assembly 10. As shown in FIGS. 1 and 2, an upstream cable passage 32 formed in a corner peripheral surface of the upstream connector body section 310 aligns with a main body channel 130 that cradles an upstream portion of the USB cable 100 leading to the upstream connector 300 to cradle the upstream portion of the USB cable 100 along a periphery of the main body section 200. The upstream portion of the USB cable 100 enters the outer casing of the upstream connector body section 310 through the upstream cable passage 32 and is connected to the upstream connector 300. The upstream connector 300 is fixedly attached to the upstream connector body section 310 so that the upstream connector body section 310 houses and protects the USB cable 100 connection to the upstream connector 300.

Figure 2:
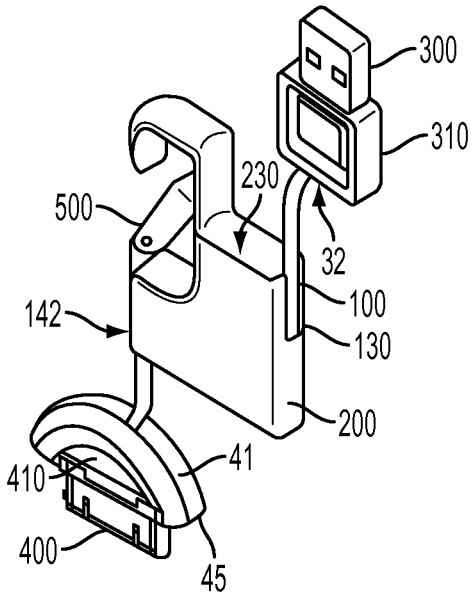
FIG. 2 is a another perspective view of the cable assembly shown in FIG. 1.
Figure 3:
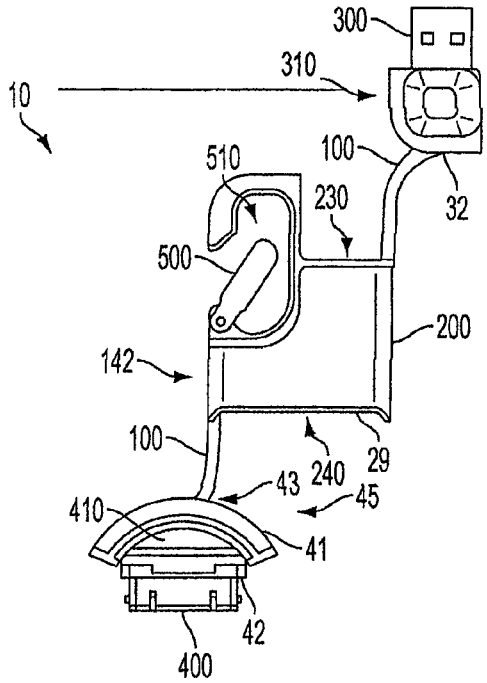
FIG. 3 is a planar view of the USB cable assembly shown in FIGS. 1 and 2.
Figure 5:
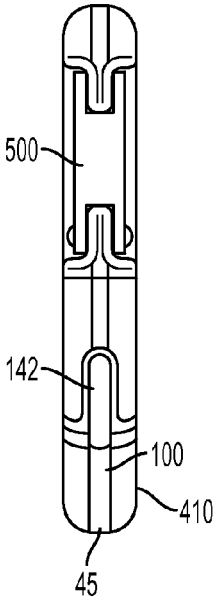
Figure 6:
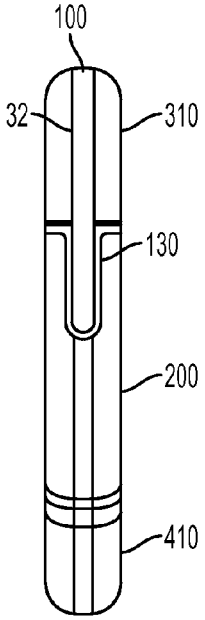
Figure 7:
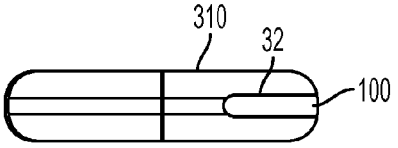
Figure 8:
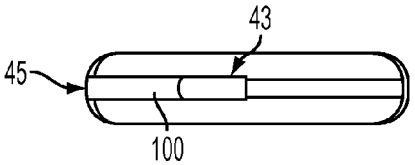

As shown in FIGS. 1-6 and 8, the downstream connector body section 410 may be formed as a half-disc, for example, with an outer casing having a rounded semicircular edge 41 and a mating surface 42. The downstream portion of the USB cable 100 enters the outer casing of the downstream connector body section 410 through a downstream passage 43 and is connected to the downstream connector 400. A downstream body channel 45 (as shown in FIGS. 2, 5 and 8) may be formed in the semicircular edge 41 along a peripheral arc from where the USB cable 100 enters the downstream connector body section 410, at the downstream passage 43, to a lateral edge of the mating surface 42.

When the downstream connector 400 is placed in the stored position, as shown in FIG. 4, i.e., when fully inserted into the downstream connector port 240, the mating surface 42 of the main body section 200 abuts an end surface 29 of the downstream connector body section 410. As shown in FIG. 5, a cable passage 142 may be formed in a peripheral surface of the main body section 200. The cable passage 142 aligns with the downstream body channel 45 to cradle the downstream portion of the USB cable 100 along a periphery of the downstream connector body section 410. The downstream connector 400 is fixedly attached to the downstream connector body section 410 so that the downstream connector body section 410 houses and protects the USB cable 100 connection to the downstream connector 400.

In use, the USB cable assembly 10, which may be secured to a keychain, belt loop or backpack ring, via the hinged spring-loaded arm 500 of the carabiner clip and through-hole 510, for example, is placed into the operational configuration by slidably removing the upstream and downstream connectors, 300 and 400, from the upstream and downstream connection ports 230 and 240, respectively. The unitary design of the cable assembly 10 ensures that the USB cable 100 remains slidably secured to the main body section 200 when the upstream and downstream connector body sections 310 and 410 are respectively disengaged. In this manner, all components of the cable assembly 10 remain continuously attached at all times, whether or not the cable assembly 10 is being used in an operational or storage configuration. Thus, a user will not misplace or lose a protective cap, for example, and can be assured that the critical components of the cable assembly 10 may always be stored in an efficient, protective manner, preventing damage and extending the effective life of the cable assembly 10 indefinitely. Furthermore, the user is able to securely store the cable assembly 10 in an accessible storage location and have the ability to remove the cable assembly 10 from its stored location for use.

In accordance with another aspect of the present disclosure, with the cable assembly 10 in an operational configuration, a distance that the upstream and downstream connectors, 300 and 400, can respectively extend away from the main body section 200 may be adjusted. For example, when initially disengaged from the main body section 200, the upstream connector body section 310 and the downstream connector body section 410 extend a predetermined distance from the main body section 200. Because the USB cable 100 is not fixed to the main body section 200, but slidably passes through the main body section 200, pulling on either of the upstream connector body section 310 or the downstream connector body section 410 will extend the respective body section 310 or 410 a distance from the main body section 200. The other of the upstream connector body section 310 or the downstream connector body section 410 will simultaneously retract the same distance toward the main body section 200 as the USB cable 100 is pulled through the main body section 200. The length that either of the upstream connector body section 310 or the downstream connector body section 410 can extend is limited only by the predetermined distance that the other of the upstream connector body section 310 or the downstream connector body section 410 initially extends from the main body section 200 upon disengagement from a stored configuration.

Once the cable assemble 10 is opened and configured as desired by the user, the upstream connector 300 may be connected to an appropriate port on the host device, and the downstream connector 400 connected to an appropriate port on the PED. The host may thus supply a predetermined current or power to the PED at 5V while simultaneously exchanging data with the PED in accordance with a specified USB standard, which may be USB 2.0 or USB 3.0, for example.

The USB cable assembly 10 may be placed in a storage configuration by inserting the upstream connector 300 into the upstream connector port 230 so that the upstream connector body section 310 seats flush with the main body section 200. The downstream connector 400 is inserted into the downstream connector port 240 so that the downstream connector body section 410 seats flush with the main body section 200. As shown in FIG. 2, when in the storage position, the upstream and downstream connectors, 300 and 400, occupy an upper and a lower space inside the main body section 200 and are separated substantially by a thickness of the USB cable 100. The upstream portion of the USB cable 100 may be pulled taut and secured into the main body channel 130, and the downstream portion of the USB cable 100 may be pulled taut and secured into the downstream body channel 45. The channels 130 and 45 effectively shield and protect the USB cable 100 from damage by preventing exposure to direct impacts and snags, for example. Due to the compact and efficient configuration of the USB cable assembly 10, as described above, the assembly is able to be lightweight, ergonomic and cost-efficient to manufacture while providing substantial protection to the critical components of the assembly, and being easily stored on and retrieved from a convenient hook or loop by operation of the carabiner hinged spring-loaded arm 500.

FIGS. 9-19 show another variation of a USB cable assembly 900, in accordance with aspects of the present disclosure, in which the USB cable assembly 900 may be provided with multiple downstream connectors, such as dual mini and micro USB connectors. As show in FIGS. 9-19, the USB cable assembly 900 shares similar aspects with respect to the upstream side of the USB cable assembly 10, including a Type-A upstream connector 800, an upstream connector body section 530 and a main body section 520 provided with an upstream connector port 730 for receiving the upstream connector 800, and a hinged spring-loaded arm 500 of the carabiner claim and through-hole 510.

Figure 9:
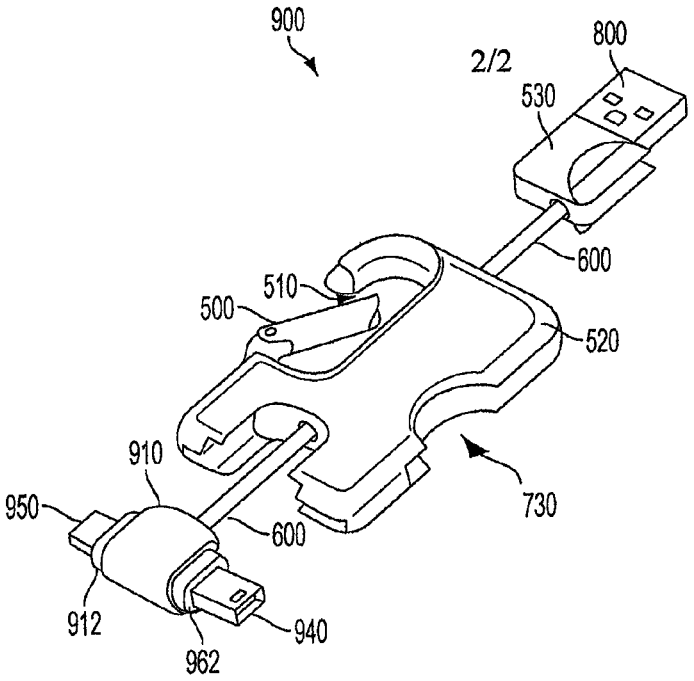
FIG. 9 is a perspective view of a second embodiment of a cable assembly in a first configuration, in accordance with aspects of the present disclosure.
Figure 10:
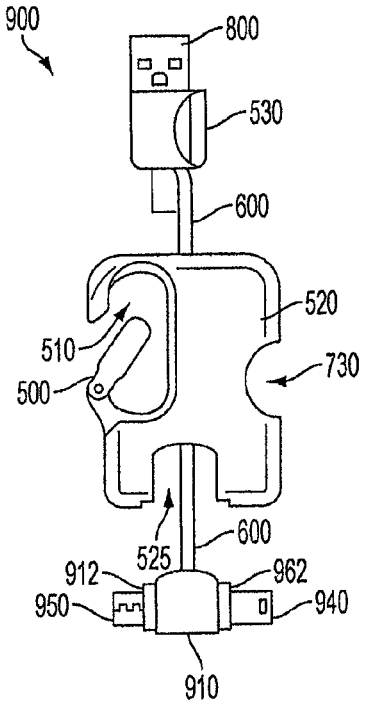
FIG. 10 is a planar view of the cable assembly shown in FIG. 9.
Figure 11:
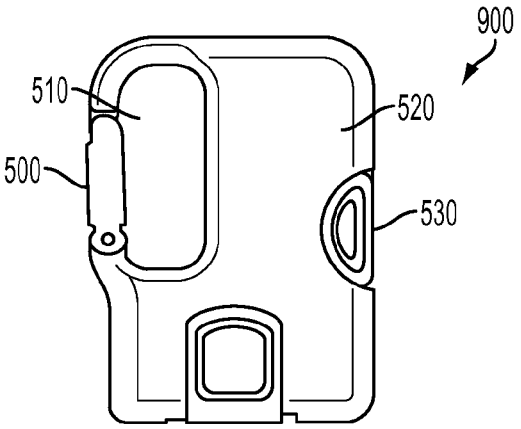
FIGS. 11-19 are various views of the cable assembly shown in FIG. 9 in a second configuration, in accordance with aspects of the present disclosure.
Figure 12:
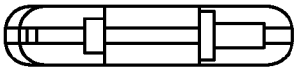
Figure 13:
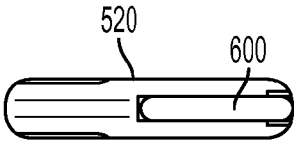
Figure 14:
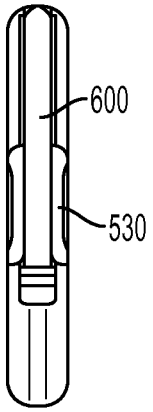
Figure 15:
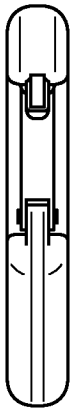
Figure 16:
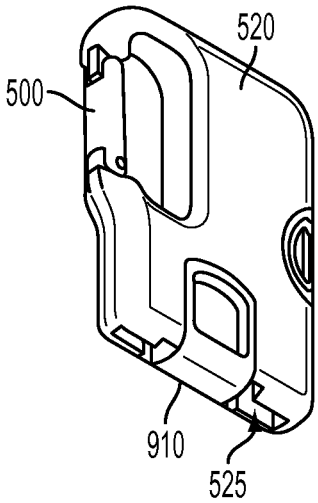
Figure 17:
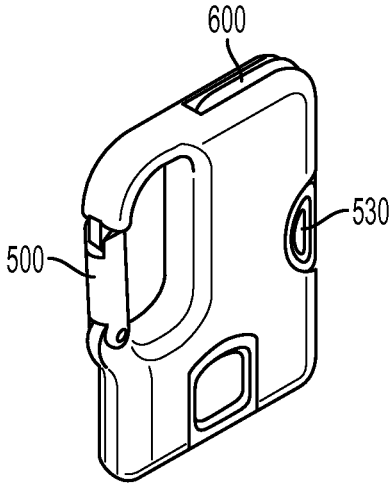
Figure 18:
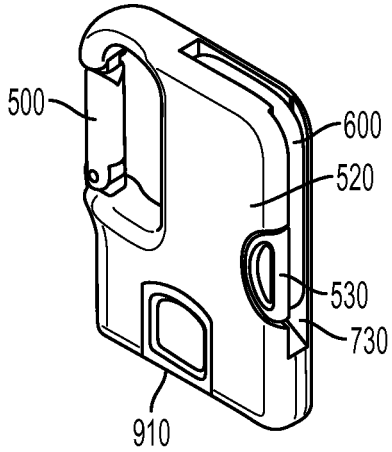
Figure 19:
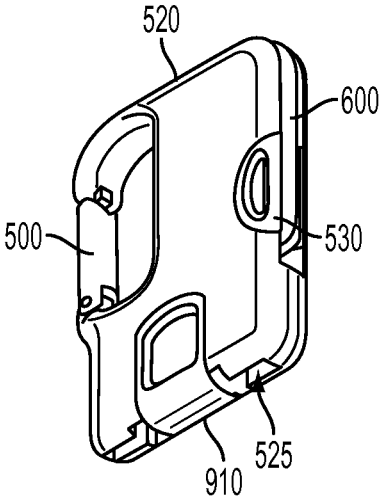

The downstream side of the USB cable assembly 900, as depicted in FIGS. 9-10, has a first downstream connector 940, which may be a mini-A or mini-B type USB connector, and a second downstream connector 950, which may be a micro-A or micro-B type USB connector. The first and second downstream connectors, 940 and 950, may secure to and extend from a housing 910 via a cable 600. The housing 910 may be formed with a first main body insertion step 912 and a second main body insertion step 962. To place the USB cable assembly 900 into a storage configuration, the first housing 910 is slidably received into the main body section 520. First and second main body insertion steps, 912 and 962, present a unified, lateral insertion step that is contoured in order to be press fit, for example, into a main body downstream port 525, of the main body section 520.

The main body section 520 has an interior chamber (not shown) for storing and protecting the cable 600, when the USB cable assembly 900 is placed into a storage configuration. As shown in FIGS. 9 and 10, the USB cables 600 extends from the housing 910. The cables 600 extends from the housing 910 toward the main body downstream port 525. As shown in FIGS. 11-19, when the USB cable assembly 900 is placed into the storage configuration, the cables 600 is entirely contained in the interior chamber of the main body section 520.

The unitary design of the cable assembly 900 ensures that the USB cable 600 remains secured to the main body section 520 when the upstream connector 800 and both downstream connectors 940 and 950 are respectively disengaged. In this manner, all components of the cable assembly 900 remain continuously attached at all times, whether or not the cable assembly 900 is being used in an operational or storage configuration. Thus, a user will not misplace or lose a protective cap, for example, and can be assured that the critical components of the cable assembly 900 may always be stored in an efficient, protective manner, preventing damage and extending the effective life of the cable assembly 500 indefinitely. Furthermore, the carabiner hinged spring-loaded arm 500 and the through-hole 510 enable the user to easily store and retrieve the cable assembly 900.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but is to be accorded the full scope consistent with the language claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A cable assembly for connecting a portable electronic device to a host device, comprising:

a cable;

an upstream connector coupled to the cable;

a downstream connector coupled to the upstream connector by the cable; and a main body section for retaining the cable having an attachment mechanism comprising a through hole formed in the main body, the through hole including on a side a carabiner clip comprising a hinged spring-loaded inwardly movable portion completing the through hole, wherein the main body section further comprises an upstream connector port configured to slidably receive the upstream connector and a downstream connector port configured to slidably receive the downstream connector, wherein the cable is slidably secured to the main body section, and wherein the cable assembly further comprises an upstream connector body having the upstream connector extending from the upstream connector body;

a downstream connector body having the downstream connector extending from the downstream connector body;

a downstream connector body cable channel on a peripheral surface of the downstream connector body configured to cradle a first portion of the cable; and an upstream connector body cable channel on a peripheral surface of the upstream connector body configured to cradle a second portion of the cable.

2. The cable assembly of claim 1, further comprising a downstream connector body section, wherein the downstream connector is mounted to the downstream connector body section, and wherein the cable connects to the downstream connector at a point interior to the downstream connector body section.

3. The cable assembly of claim 2, wherein the downstream connector body section further comprises a downstream body channel for securing the cable to a peripheral surface of the downstream connector body section when the downstream connector is slidably inserted into the downstream connector port.

4. The cable assembly of claim 2, further comprising an upstream connector body section, wherein the upstream connector is mounted to the upstream connector body section, and wherein the cable connects to the upstream connector at a point interior to the upstream connector body section.

5. A cable assembly for connecting a portable electronic device to a host device, comprising:

an upstream connector body having an upstream connector extending from the upstream connector body;

a downstream connector body having a downstream connector extending from the downstream connector body;

a cable connecting the upstream connector to the downstream connector, wherein the upstream and downstream connector bodies are arranged to form at least part of a unified body when in a storage configuration;

a downstream connector body cable channel on a peripheral surface of the first downstream connector body when the upstream and downstream connector bodies are in the storage configuration, the downstream connector body cable channel configured to cradle a first portion of the cable; and an upstream connector body cable channel on a peripheral surface of the upstream connector body when the upstream and downstream connector bodies are in the storage configuration, the upstream connector body cable channel configured to cradle a second portion of the cable.

6. The cable assembly of claim 5, wherein the upstream and downstream connectors are secured in the unified body when in a storage configuration.

7. The cable assembly of claim 6, further comprising a downstream connector port, wherein the downstream connector is inserted in the downstream connector port to secure the downstream connector in the unified body when in the storage configuration.

8. The cable assembly of claim 7, wherein the downstream connector is removed from the downstream port for connecting the cable assemble to the portable electronic device.

9. The cable assembly of claim 6, further comprising an upstream connector port, wherein the upstream connector is inserted in the upstream connector port to secure the upstream connector in the unified body when in the storage configuration.

10. The cable assembly of claim 9 wherein the upstream connector is removed from the upstream connector port for connecting the cable assembly to the portable electronic device.

11. The cable assembly of claim 6, further comprising a main body section, the main body section configured to secure the upstream and downstream connectors when the upstream and downstream connector bodies are in the storage configuration in the main body.

12. The cable assembly of claim 5, wherein the downstream connector is a 30 pin connector.

13. The cable assembly of claim 5, wherein the downstream connector is a Mini-A or a Mini-B type USB connector.

14. The cable assembly of claim 5, wherein the upstream connector is a male 4 pin Type A USB connector.

15. The cable assembly of claim 5, wherein the cable delivers power from the host device to the portable electronic device at a voltage of 5V.

16. The cable assembly of claim 5, wherein the cable connects to the downstream connector at a point interior to the downstream connector body.

17. The cable assembly of claim 5, wherein the cable connects to the upstream connector at a point interior to the upstream connector body.

* * * * *